United States Patent [19]

Larson

[11] 3,987,259

[45] Oct. 19, 1976

[54] MEMBRANE SWITCH APPARATUS HAVING SEQUENTIAL BRIDGING CONTACT ARRANGEMENT

[75] Inventor: Willis August Larson, Mequon, Wis.

[73] Assignee: Globe-Union Inc., Milwaukee, Wis.

[22] Filed: June 12, 1975

[21] Appl. No.: 586,242

[52] U.S. Cl. ..... 200/5 A; 200/159 B

[51] Int. Cl.[2] ..... H01H 13/52

[58] Field of Search ..... 200/5 A, 5 R, 159 B, 200/243, 275, 292, 5, 159; 340/365

[56] References Cited

UNITED STATES PATENTS

| | | | |
|---|---|---|---|
| 3,584,162 | 6/1971 | Krakinowski | 200/159 B X |
| 3,600,528 | 8/1971 | Leposavic | 200/5 A |
| 3,728,509 | 4/1973 | Shimojo | 200/159 B |
| 3,735,068 | 5/1973 | Yanaga et al. | 200/159 B |
| 3,742,157 | 6/1973 | Leposavic | 200/159 B X |
| 3,743,797 | 7/1973 | Hoffman | 200/159 B X |
| 3,760,137 | 9/1973 | Shimojo et al. | 200/5 A X |
| 3,898,421 | 8/1975 | Suzumura | 200/5 A |

*Primary Examiner*—James R. Scott

*Attorney, Agent, or Firm*—James L. Kirschnik; John Phillip Ryan

[57] ABSTRACT

Membrane switch apparatus is disclosed, in its preferred form, as a keyboard including an insulator with an array of individual switching units located thereon. Each individual switching unit includes a plurality of first electrode members and a plurality of second electrode members. A flexible, nonconductive member is disposed in a spaced relation above and adjacent to the level of the top surfaces of the electrode members of the array of individual switching units. The flexible member includes conductive material located thereon in a patterned arrangement to allow sequential bridging first, of the plurality of the first electrode members and, second, of the plurality of second electrode members.

30 Claims, 5 Drawing Figures

MEMBRANE SWITCH APPARATUS HAVING SEQUENTIAL BRIDGING CONTACT ARRANGEMENT

BACKGROUND

The present invention relates generally to switches, specifically to switches actuated by touch, and more specifically to membrane switch apparatus.

An increasing demand for switch apparatus having the ability to provide sequential output signals for use with electric circuits is now being experienced. For example, in touch-tone telephone switches, electrical connection must be made between a common conductor, one high tone contact, and one low tone contact before the DC current of the electric circuit is turned on.

Further increased interest in electronic apparatus having switch keyboards, such as calculators, typewriters, and similar apparatus, has increased the demand for keyboard apparatus. Such keyboard apparatus preferably includes a minimum number of components which can be easily manufactured and which lend themselves to mass production techniques, thus reducing the cost of materials and labor.

SUMMARY

The apparatus of the present invention solves these and other problems in membrane switch apparatus by providing, in the preferred embodiment, membrane switch apparatus including at least first switch electrode members and at least second electrode members electrically insulated from the first electrode members. A flexible, nonconductive member is disposed in a spaced relation above and adjacent to the level of the top surfaces of the electrode members and includes conductive members formed thereon allowing sequential electrical contact of the first electrode members and the second electrode members.

It is a primary object of the present invention to provide novel membrane switch apparatus.

It is a further object of the present invention to provide a membrane switch apparatus which includes a minimum number of components.

It is a further object of the present invention to provide a membrane switch apparatus which is simple in design, easy to manufacture, lends itself to mass production techniques, and which maximises utilization of the materials used.

It is a further object of the present invention to provide a membrane switch apparatus which provides sequential output signals for use with the electric circuits.

It is a further object of the present invention to provide a membrane switch apparatus which can be utilized in keyboard apparatus.

These and other objects and advantages of the present invention will become clearer in the light of the following detailed description of an illustrative embodiment of this invention described in connection with the drawings.

DESCRIPTION

Figure 1:
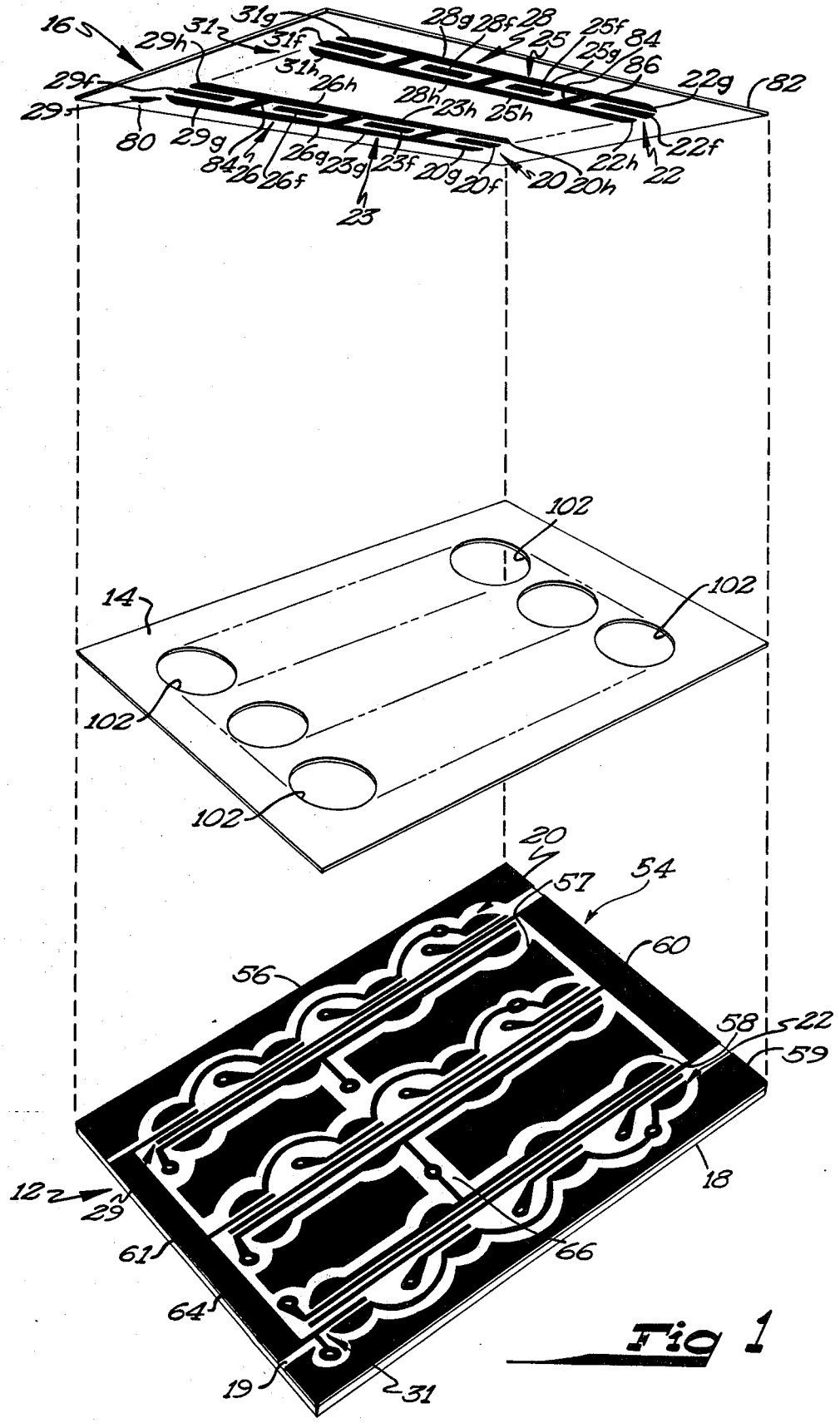
FIG. 1 is an exploded perspective view of membrane switch apparatus according to the present invention.
Figure 2:
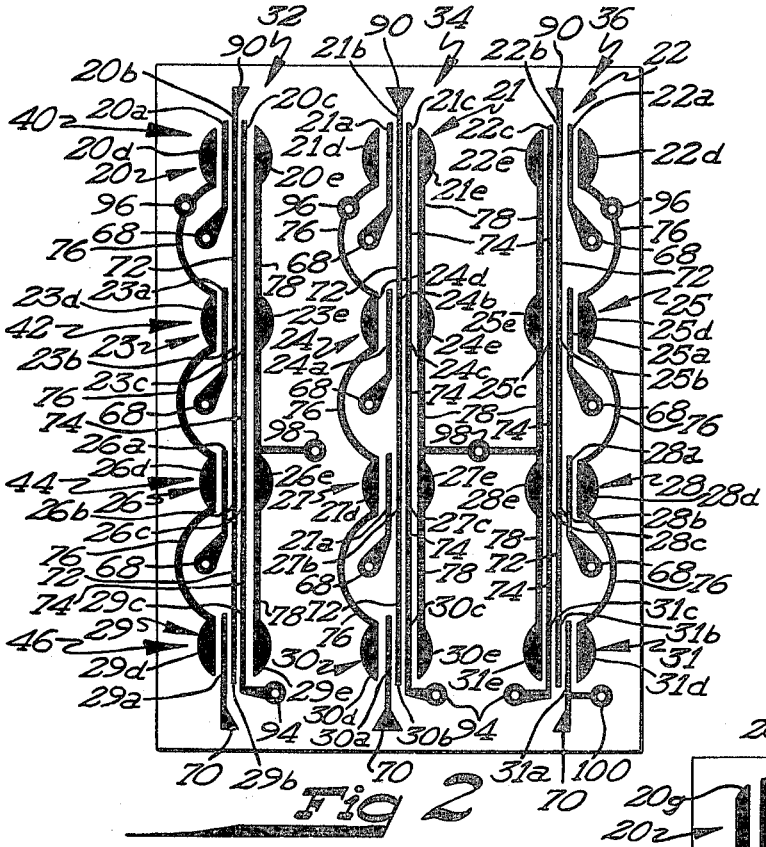
FIG. 2 is a top view of the electrodes of the apparatus of FIG. 1.
Figure 4:
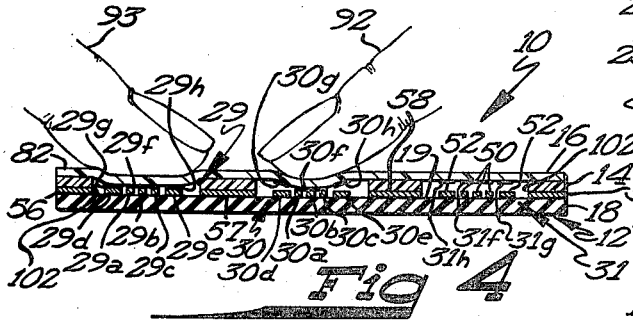
FIG. 4 is a cross-sectional view of the apparatus of FIG. 1, with individual switching units shown as being actuated by fingers.

In FIGS. 1, 2 and 4, a preferred form of membrane keyboard apparatus utilizing the teachings of the present invention is generally designated 10. Keyboard 10 includes an insulator component 12, a member 14 for positioning the membrane in a spaced relation above and adjacent to the level of the top surfaces of the electrode members of the array of individual switching units, and a membrane member 16. Insulator component 12 includes an insulator 18 having a first face 19. An array of individual switching units 20–31, are located on and supported by face 19 of insulator 18. Switching units 20–31 are arranged in three columns designated 32, 34, and 36 and four rows designated 40, 42, 44, and 46. Therefore, switching unit 20 is located in column 32 and row 40, and switching unit 27 is located in column 34 and row 44, with the remaining switching units being located at the various intersections of the columns 32, 34, and 36 with the rows 40, 42, 44, and 46.

Each of the individual switching units 20–31 include a plurality of first electrode members, shown in the preferred embodiment as electrode members *a*, *b*, and *c*. Electrode members *a–c* are electrically insulated from each other and are located generally centrally of the switching units. Electrode members *a–c* have a top surface 50, illustrated in FIGS. 4 and 5. Therefore, switching unit 20 includes a plurality of first electrode members identified as electrode members 20*a*, 20*b*, and 20*c*, and similar designations are used for switching units 21–31.

Each of the individual switching units 20–31 include a plurality of second electrode members, shown in the preferred embodiment as electrode members *d* and *e*. Electrode members *d* and *e* are electrically insulated from each other and from electrode members *a–c*. Electrode members d and e may be located generally at the periphery of the switching units 20–31, on opposite sides of electrode members *a–c*, and further removed from the center of the switch actuation locus. Electrode members *d* and *e* have a top surface generally designated 52 which, in the preferred embodiment, has a height level equal to the height level of top surface 50 of electrode members *a–c*. Therefore, switching unit 20 includes a plurality of second electrode members identified as electrode members 20*d* and 20*e*, and similar designations are used for switching units 21–31.

Insulator component 12 further includes a conductive sheet member 54 having a top surface 64 and which is arranged in a patterned arrangement around switching units 20–31. Generally, sheet member 54 includes portions 56–59 arranged adjacent the columns 32, 34, and 36 of the array of individual switching units 20–31 and portions 60 and 61 arranged above row 40 and below row 46, respectively, of the array of individual switching units 20–31. Portions 56–61 are electrically insulated from each other. In the preferred embodiment, portions 57 and 58 have removed portions 66 passing entirely therethrough between row 42 and 44 of the array of individual switching units, whose purpose will be explained hereinafter.

As best illustrated FIG. 2 electrode members *a–c* are formed from linear strips of conductive material and electrode members d and e formed of truncated, semicircular members. Electrode members 20*a*, 23*a*, and 26*a* are each electrically connected to separate, enlarged electrical connection members 68 used for electrically connecting electrode members 20*a*, 23*a*, and 26*a* to electric circuits, not specifically shown. Electrode member 29*a* is electrically connected to electrical connection element 70 allowing electrical connection to electric circuits, not specifically shown. Electrode members 20*b*, 23*b*, 26*b*, and 29*b* are formed from and electrically connected together by a continuous linear strip 72 electrically connected to an electrical connection element 90 allowing electrical connection to electric circuits, not specifically shown. Similarly, electrode members 20*c*, 23*c*, 26*c*, and 29*c* are formed from and electrically connected together by a continuous linear strip 74 electrically connected to an electrical connection member 94 allowing electrical connection to electrical circuits, not specifically shown.

Electrode members 20*d*, 23*d*, 26*d*, and 29*d* are electrically connected together by arcuate strips 76 located therebetween. Included in at least one of arcuate strips 76 is an electrical connection member 96 also used for electrically connecting electrode members 20*d*, 23*d*, 26*d*, and 29*d* to electric circuits, not specifically shown. Electrode members 20*e*, 23*e*, 26*e* and 29*e* are electrically connected together by linear strips 78 located therebetween. Electrical connection member 98 is further provided within the removed portion 66 of portion 57 and electrically connected to at least one strip 78 for electrically connecting electrode members 20*e*, 23*e*, 26*e*, and 29*e* to electric circuits, not specifically shown.

A complete and detailed description of electrode members *a*, *b*, *c*, *d*, and *e* of switch units 20, 23, 26, and 29 located within column 32 of the array of individual switch units 20–31 has now been set forth, and it can now be appreciated that the electrode members *a*, *b*, *c*, *d*, and *e*, of switch units 21, 24, 27, and 30 located within column 34 and of switch units 22, 25, 28, and 31 located within column 36 are similarly arranged on face 20 of insulator 18, except, in the preferred embodiment, that electrode members *a*, *b*, *c*, *d*, and *e* of switch units 22, 25, 28, and 31 of column 36 are arranged in a reverse mirror image.

It should further be noted, electrodes 21*e*, 24*e*, 27*e*, and 30*e* of column 34 and electrodes 22*e*, 25*e*, 28*e*, and 31*e* of column 36 may share a common electrical connection member 98 located within removed portion 66 of portion 58. Further, electrode 31*a* is electrically connected to an electrical connection member 100. In the preferred embodiment, best illustrated in FIG. 1, elements 90 of strips 72 forming electrode members b of switch units 20–31 electrically contact and electrically connect with portion 60, and electrical connection is made between portion 60 and the electric circuits, not specifically shown. Similarly, elements 70 of electrode members 20*a*, 30*a*, and 31*a* electrically contact and electrically connect with portion 61.

It should be noted that the electrode means *a*, *b*, *c*, *d*, and *e*, strips 72, 74, 76, and 78, electrical connection members 68, 70, 90, 94, 96, 98, and 100, and portions 56–62 can be formed by any suitable method such as by printing on an insulator or etching a conductive clad insulator, or similar techniques may be used.

Membrane member 16 is formed of a thin, flexible, sheet member 80 having a high strength to mass ratio and including a bottom surface 82. Sheet member 80 is preferably formed of nonconductive material, such as polyester sold under the trade name Mylar having a thickness substantially equal to between 3 to 10 mils (0.00772 to 0.0254 centimeters). Membrane member 16 further includes an array of conductive members corresponding to the array of individual switch units 20–31 formed on bottom surface 82 of sheet member 80.

Each conductive member includes a first conductive portion generally shown and designated *f*, generally located adjacent to the center of switch actuation locus and generally vertically above and adjacent to electrode members *a*, *b*, and *c* for electrically contacting and bridging between first switch electrode members *a*, *b*, and *c*. Each conductive member further includes a second conductive portion electrically insulated from first conductive portion *f*, shown in the preferred embodiment as conductive portions *g* and *h*. Conductive portion *g* is arranged generally vertically above and adjacent to electrode member *d* for electrically contacting therewith and conductive portion *h* is arranged generally vertically above and adjacent to electrode member *e* for electrically contacting therewith. Second conductive portion, as shown in the preferred embodiment as portions *g* and *h*, is located generally at the periphery of the switch actuation locus and further removed from the center of the switch actuation locus. Conductive portions *g* and *h* are electrically connected to each other by conductive material 84. Therefore, when conductive portion *g* electrically contacts electrode member *d* and conductive portion *h* electrically contacts electrode member *e*, conductive portions *g* and *h* and material 84 electrically bridge between electrode members *d* and *e*. Portion *g* of switch units 20, 23, 26, and 29 of column 32 may be electically connected together and formed by continuous conductive patterns 86. Portions *h* of switch units 20, 23, 26, and 29 of column 32 may be electrically connected together and formed by continuous conductive patterns 88. Conductive portions *g* and *h* of switch units 21, 22, 24, 25, 27, 28, 30, and 31 of columns 34 and 36 of the array of individual switch units may be formed in a similar manner. Therefore portions *g* and *h* and material 84 form a ladder type arrangements where patterns 86 and 88 form the runners and material 84 forms the rungs or steps. Material 84 and conductive patterns 86 and 88 may be formed from a resistive or carbonacous paint or silver or other conductive material sprayed or screened on bottom surface 82 of sheet member 80 and having a thickness of substantially 0.1 mils (0.000254 centimeters).

It will be appreciated that individual switching unit 20 includes first conductive portion 20f which electrically contacts and bridges between first electrode members 20*a*, 20*b*, and 20*c* and second conductive portions 20*g* and 20*h* which electrically contacts second electrode members 20*d* and 20*e*, respectively, and due to material 84, electrically bridges therebetween. The remaining switch units 21–31 are similarly constructed.

Keyboard 10 further includes a spacer 14 for positioning membrane member 16 in a spaced relation above and adjacent to the level of the top surface of the electrode members a-c of individual switching units 10–31. Spacer 14 is formed of non-conductive material such as Mylar plastic film and includes an array of apertures 102 formed therethrough corresponding to the array of individual switching units 20–31. Therefore, apertures 102 are located over and expose electrode members *a, b, c, d,* and *e* of the individual switching units 20–31. As best seen in FIG. 4, spacer 14 rests on insulator component 12 and supports membrane member 16. Therefore, portions *f–h* formed on sheet member 80 of membrane member 16 are held in a spaced relation above and adjacent to electrode members *a–e* of individual switch units 20–31. It should be noted that portions 56–61 may be omitted if insulator 14 of the first preferred embodiment is provided.

Figure 5:
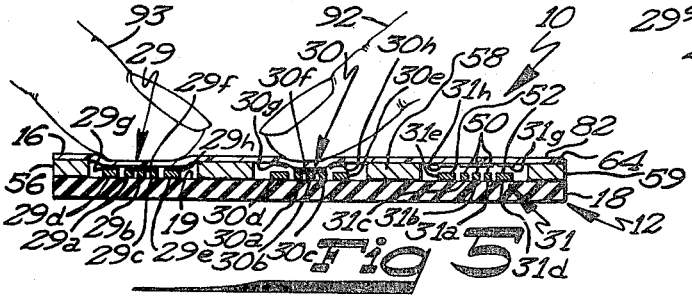
FIG. 5 is a cross-sectional view of the apparatus according to FIGS. 1 and 3, with individual switching units shown as being actuated by fingers.
Figure 3:
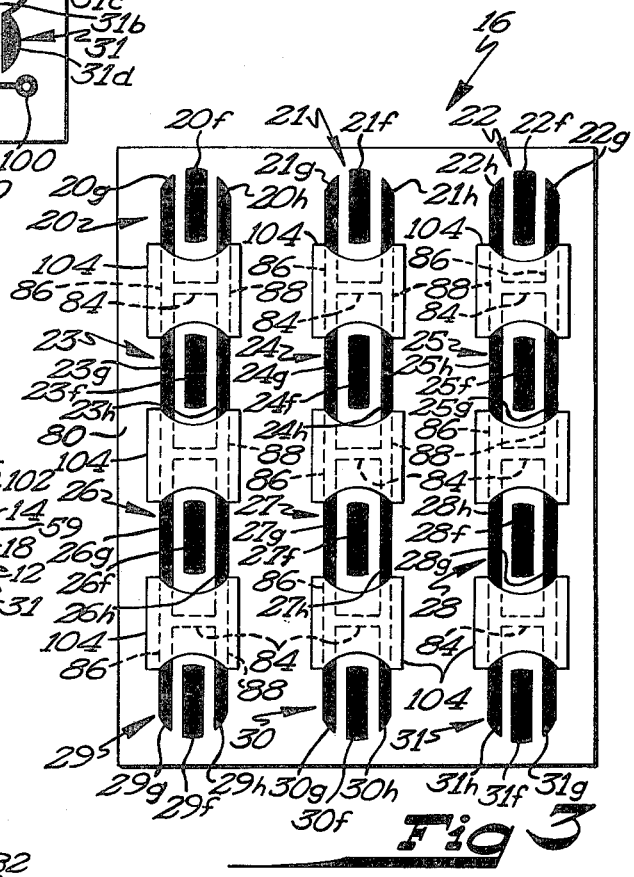
FIG. 3 is a mirror image bottom view of a modified membrane member of the apparatus of FIG. 1.

An alternate preferred form of the means for positioning membrane member 16 in a spaced relation above and adjacent to the level of the top surfaces of the electrode members *a–c* of individual switch units 20—31 is shown in FIGS. 3 and 5. As shown in FIG. 3, membrane member 16 further includes insulator members 104 formed of nonconductive material which is placed on bottom surface 82 of sheet member 80 over material 84 and strips 86 and 88 located adjacent thereto, whose purpose will be explained hereinafter.

In the second embodiment, top surface 64 of portions 56–61 is spaced vertically above top surfaces 50 and 52 of electrode members *a, b,* and *c* and *d* and *e,* respectively. In other words, the coplanar top surface 64 of portions 56–61 lie above the coplanar top surfaces 50 and 52 of electrode members *a–e* forming the plurality of first and second electrode members of individual switching units 20–31. Therefore, membrane member 16 can rest directly on and be supported by top surface 64 of portions 56–61, as seen in FIG. 5. Therefore, portions *f–h* formed on sheet member 80 of membrane member 16 are held in a spaced relation above and adjacent to electrode members *a–e* of individual switch units 20–31.

The insulator members 104 formed on membrane member 16 prevent accidental bridging of strips 72 and 74 by conductive material 84 between rows 40, 42, 44, and 46 of the array of individual switching units 20–31. For example, if pressure was placed on membrane member 16 at an area above conductive material 84 out of the switch actuation locus rather than the area above conductive portions *f, g,* and *h* within the switch actuation locus, insulator members 104 prevent conductive material 84 located between strip 86 and 88 from bridging between strips 72 and 74 or with electrical connection members 68.

It will be appreciated that although electrode members *a–e* and their associated electrical connection means and portions *f–h* are shown in their preferred form, other forms of electrode members *a–e,* electrical connection means and portions *f–h* will be known to those skilled in the art upon reading and understanding of the present invention. For example, electrode members *a–e* and portions *f–h* can be formed such that insulator members 104 will not be required as shown in the second preferred embodiment.

OPERATION

Generally, in operating the membrane keyboard apparatus 10 according to the teachings of the present invention, the finger of an operator is placed upon a selected individual switch unit, of units 20–31, for example, switch unit 29 and finger 92 and switch unit 30 and finger 93 as shown in FIGS. 4 and 5.

In an unactuated position, portions *f, g,* and *h* are held in a spaced relation above and adjacent to electrode members *a, b, c, d,* and *e* by insulator member 14 as shown in FIGS. 1, 2, and 4 or by portions 56–61 as shown in FIGS. 3 and 5.

Upon placement of finger 92 or 93 on a selected individual switching unit, of units 20–31, for example, switching units 20 or 30 as shown in FIGS. 4 and 5, pressure would then be placed on membrane member 16 by the finger. Membrane member 16 would then deflect in the direction of the pressure applied by the finger, or in other words, in a concave fashion. Since portions *f, g,* and *h* are located on bottom surface 82 of sheet member 80 forming membrane member 16, portions *f, g,* and *h* will deflect towards electrodes *a–e.* As sheet member 80 deflects, portion *f* will initially deflect at a greater rate in that portion *f* is located generally centrally of the switch actuation locus. In the preferred embodiment, portion *f* lies generally centrally of the concave deflection of sheet member 80 by the finger. Therefore, portion *f* will electrically contact and bridge between electrode members *a, b,* and *c* before portion *g* and *h* electrically contact electrode members *d* and *e,* respectively, as best seen in FIGS. 4 and 5 by finger 92 deflecting portion 30*f* into electrode members 30*a,* 30*b,* and 30*c* of individual switching unit 30. Upon continued deflection of sheet member 80 by the finger, member 80 will continue to deflect until portions *g* and *h,* located at the periphery of the switch actuation locus and further removed from the center of the switch actuation locus, electrically contact and bridge between electrode members *d* and *e,* respectively, as best seen in FIGS. 4 and 5 by finger 93 deflecting portions 29*f* into electrode members 20*a,* 20*b,* 29*c* and portions 29*g* and 29*h* into electrode members 29*d* and 29*e,* respectively, of switching unit 29.

Therefore, a sequential output signal is made to the electric circuits in that a first output signal is received by the electric circuits by the electrical connection and bridging of switch electrode members *a, b,* and *c* by portion *f* and a second output signal is received by the electric circuits by the electrical connection and bridging of electrode members *d* and *e* by portions *g* and *h.* It should be noted, that it is impossible for portions *g* and *h* to electrically contact and bridge between switch electrode members *d* and *e* before portion *f* electrically contacts and bridges between switch electrodes *a, b,* and *c.* This can be used, for example, to create a mechanical interlock assuring that electrical contact is made with first electrode members before electrical contact is made with second electrode members, such as in touch-tone telephonic switchboards.

When the operator removes finger 92 or 93 from membrane member 16, member 16 will return to its first, nonactuated position. Individual switch unit 29 or 30 is thus returned to an open switch position because portions *f–h* are electrically spaced and insulated from electrode members *a–e.*

A further sublety of the switch elements of the switch apparatus of the present invention can now be appreciated. In the preferred embodiment, switch electrodes *a, b,* and *c* are located generally centrally of the switch actuation locus and electrodes *d* and *e* are located on opposite sides of electrode members *a, b,* and *c* and generally at the periphery of the switch actuation locus and further removed from the center of the switch actuation locus. Electrical connection is made by portions *g* and *h* and material 84 and therefore create a U-shaped electrical connection bridging path between electrode members *d* and *e*. Therefore, if sheet member forming membrane member 16 were to be deflected by a sharp object other than a rounded object such as the finger of the operator, for example, in an extreme case, by the use of a ball-point pen such that membrane member 16 does not deflect in a concave fashion or deflect generally centrally from the switch actuation locus, and therefore portion *g* electrically contacts electrical member *d* or portion h electrically contacts electrode member *e* before electrical connection is made between portion *f* and all of electrode members *a*, *b*, *c*, electrical connection between electrode members *d* and *e* will not be made in that in order to deflect member 80 into both electrodes d and e simultaneously, it would require that member 80 also deflect into electrode members *a*, *b*, and *c* before electrical connection is made between electrode members *d* and *e* due to the preferred structure of the preferred embodiment.

The membrane keyboard apparatus 10 according to the present invention lends itself to mass production techniques. For example, to assemble apparatus 10, membrane member 16, insulator 14, and insulator component 12 are simply dropped into a bezel member, not shown, in the first preferred embodiment, or membrane member 16 and insulator component 12 are simply dropped into a bezel member, not shown, in the second preferred embodiment. It can further be appreciated that membrane keyboard apparatus 10 of the present invention includes only a minimum number of components which can be easily manufactured at a low cost and which lend themselves to mass production techniques, thus reducing the expenses for material and labor.

While two embodiments of the invention have been described, the scope of the invention is not to be limited thereby but is to be taken solely from an interpretation of the claims which follow:

I claim:

1. Membrane keyboard apparatus for accepting input signals from the touch of a user and for providing sequential output signals for use with electric circuits comprising, in combination: an insulator including a first face; at least one individual switching unit located on the first face of the insulator including: at least a first switch electrode pair having top surfaces and located on the first face of the insulator, at least a second switch electrode pair having top surfaces and located on the first face of the insulator and electrically insulated from the first switch electrode pair; a flexible nonconductive member having a bottom surface arranged to be adjacent the insulator, with the flexible member having at least one conductive member formed on the bottom surface thereof corresponding to the individual switching unit, and with the conductive member including a first conductive portion for electrically contacting the first switch electrode pair and a second conductive portion electrically insulated from the first conductive portion for electrically contacting the second switch electrode pair; means for positioning the flexible member in a spaced relation above and adjacent to the level of the top surfaces of the first and second electrode pairs of the individual switching units allowing the flexible member to be deflected into the electrode pairs such that the first conductive portion electrically contacts the first switch electrode pair to thereby provide first switch closure and, upon continued deflection, the second conductive portion electrically contacts the second switch electrode pair to thereby provide second switch closure providing sequential output signals to the electric circuits; means for providing electrical connection between the first electrode means and the electric circuits; and means for providing electrical connection between the second electrode means and the electric circuits; said first switch electrode pair and the first conductive portion being located generally centrally of the switch actuation locus and said second switch electrode pair and the second conductive portion being located generally on opposite sides of the first electrode pair and first conductive portion respectively to assure that electrical contact is made with the first electrode pair before electrical contact is made with the second electrode pair.

2. Membrane keyboard apparatus for accepting input signals from the touch of a user and for providing sequential output signals for use with electric circuits comprising, in combination: an insulator including a first face; at least one individual switching unit located on the first face of the insulator including: at least first switch electrode means having a top surface and located on the first face of the insulator, at least second switch electrode means having a top surface and located on the first face of the insulator and electrically insulated from the first switch electrode means; a flexible nonconductive member having a bottom surface arranged to be adjacent the insulator, with the flexible member having at least one conductive member formed on the bottom surface thereof corresponding to the individual switching unit, and with the conductive member including a first conductive portion for electrically contacting the first switch electrode means and a second conductive portion electrically insulated from the first conductive portion for electrically contacting the second switch electrode means; means for positioning the flexible member in a spaced relation above and adjacent to the level of the top surfaces of the first and second electrode means of the individual switching units allowing the flexible member located adjacent to the electrode means of the individual switching units selected to be deflected into the electrode means such that the first conductive portion electrically contacts the first switch electrode means to thereby provide first switch closure and, upon continued deflection, the second conductive portion electrically contacts the second switch electrode means to thereby provide second switch closure providing sequential output signals to the electric circuits; means for providing electrical connection between the first electrode means and the electric circuits; and means for providing electrical connection between the second electrode means and the electric circuits, the first switch electrode means and the first conductive portion being located generally centrally of the switch actuation locus and the second switch electrode means and the second conductive portion being located generally on the periphery of the switch actuation locus to thus create a mechanical interlock assuring that electrical contact is made with the first electrode means before electrical contact is made with the second electrode means, the second electrode means including an electrode member located generally on one side of the first electrode means on the periphery of the switch actuation locus and including an additional electrode member located generally on the opposite side of the first electrode means on the periphery of the switch actuation locus, and wherein the second conductive portion includes one conductive portion associated with one of the electrode members forming the second electrode means and includes an additional conductive portion associated with the other second electrode member forming the second electrode means, and wherein the apparatus further includes conductive material located between the conductive portions forming the second conductive portion such that the second electrode means and the second conductive portions create a U-shaped electrical path around the first electrode means.

3. The apparatus of claim 2 wherein the apparatus includes an array of individual switching units, with the individual switching units located in array switch columns and array switch rows and wherein the apparatus includes an array of conductive members corresponding to the array of individual switch units.

4. The apparatus of claim 3 wherein the second electrode means of the individual switch units located in an array column are electrically connected to each other by conductive strips.

5. The apparatus of claim 4 wherein the second conductive portions of the individual switching units of an array column are formed by continuous conductive patterns such that the conductive patterns and the conductive material form a ladder type arrangement.

6. The apparatus of claim 5 wherein the height level of the top surface of the first electrode means is equal to the height level of the top surface of the second electrode means.

7. The apparatus of claim 6 wherein the first electrode means comprises a plurality of members.

8. The apparatus of claim 7 wherein the electrode members of the first electrode means comprise linear strips of conductive material.

9. The apparatus of claim 8 wherein at least one of the electrode members of the first electrode means of the individual switch units located in the array columns of the array of individual switch units are formed by and electrically connected to each other by a continuous linear strip.

10. The apparatus of claim 9 wherein the positioning means comprises in combination: a sheet member having a top surface arranged in a patterned arrangement around the individual switch units, with the top surface of the sheet member having a height level vertically above the height level of the first and second electrode means allowing the flexible member to rest on and be supported by the top surface of the sheet member.

11. The apparatus of claim 3 wherein the second conductive portions of the individual switching units of an array column are formed by continuous conductive patterns such that the conductive patterns and the conductive material form a ladder type arrangement.

12. The apparatus of claim 3 wherein the first electrode means comprises a plurality of electrode members.

13. The apparatus of claim 12 wherein the electrode members of the first electrode means comprise linear strips of conductive material.

14. The apparatus of claim 13 wherein at least one of the electrode members of the first electrode means of the individual switch units located in the array columns of the array of individual switch units are formed by and electrically connected to each other by a continuous linear strip.

15. The apparatus of claim 1 wherein the positioning means comprises in combination: a sheet member having a top surface arranged in a patterned arrangement around the individual switch units, with the top surface of the sheet member having a height level vertically above the height level of the first and second electrode means allowing the flexible member to rest on and be supported by the top surface of the sheet member.

16. The apparatus of claim 15 wherein the height level of the top surface of the first electrode means is equal to the height level of the top surface of the second electrode means.

17. Membrane keyboard apparatus for accepting input signals from the touch of a user and for providing sequential output signals for use with electric circuits comprising, in combination: insulator including a first face; an array of individual switching units located on the first face of the insulator and formed in array switch columns and array switch rows, with each individual switching unit including: at least first switch electrode means having a top surface and located generally centrally of the switch actuation locus on the first face of the insulator, with the first switch electrode means including at least a first electrode member and a second electrode member; at least second switch electrode means having a top surface and located generally less centrally of the switch actuation locus on the first face of the insulator, with the second electrode means being electrically insulated from the first electrode means and with the second electrode means including at least a third electrode member and a fourth electrode member; a flexible nonconductive member having a bottom surface arranged to be adjacent the insulator, with the flexible member having an array of conductive members formed on the bottom surface thereof corresponding to the array of individual switching units, and with each of the conductive members including a first conductive portion for electrically contacting the first switch electrode means and a second conductive portion electrically insulated from the first conductive portion for electrically contacting the second switch electrode means; means for positioning the flexible member in a spaced relation above and adjacent to the level of the top surfaces of the first and second electrode means of the individual switching units allowing portions of the flexible member located adjacent to the electrode means of the individual switching units selected to be deflected into the electrode means such that the first conductive portion electrically contacts the first switch electrode means to thereby provide first switch closure and upon continued deflection, the second conductive portion electrically contacts the second switch electrode means to thereby provide second switch closure providing sequential output signals to the electric circuits; means for providing electrical connection between the first electrode means and the electric circuits; and means for providing electrical connection between the second electrode means and the electric circuits.

18. The apparatus of claim 17 wherein the second switch electrode means and the second conductive portion are located generally on the periphery of the switch actuation locus to thus create a mechanical interlock assuring that electrical contact is made with the first electrode means before electrical contact is made with the second electrode means.

19. The apparatus of claim 18 wherein the second electrode means includes an electrode member located generally on one side of the first electrode means on the periphery of the switch actuation locus and includes an additional electrode member located generally on the opposite side of the first electrode means on the periphery of the switch actuation locus, and wherein the second conductive portion includes one conductive portion associated with one of the electrode members forming the second electrode means and includes and additional conductive portion associated with the other second electrode member forming the second electrode means, and wherein the apparatus further includes conductive material located between the conductive portions forming the second conductive portion such that the second electrode means and the second conductive portions create a U-shaped electrical path around the first electrode means.

20. The apparatus of claim 19 wherein the second conductive portions of the individual switching units of an array column are formed by continuous conductive patterns such that the conductive patterns and the conductive material form a ladder type arrangement.

21. The apparatus of claim 17 wherein the second electrode means of the individual switch units located in an array column are electrically connected to each other by conductive strips.

22. The apparatus of claim 17 wherein the first electrode means comprises and electrode member, an additional electrode member, and yet another electrode member.

23. The apparatus of claim 22 wherein the electrode members of the first electrode means comprise linear strips of conductive material.

24. The apparatus of claim 23 wherein at least one of the electrode members of the first electrode means of the individual switch units located in the array columns of the array of individual switch units are formed by and electrically connected to each other by a continuous linear strip.

25. The apparatus of claim 17 wherein the positioning means comprises in combination: a sheet member having a top surface arranged in a patterned arrangement around the individual switch units, with the top surface of the sheet member having a height level vertically above the height level of the first and second electrode means allowing the flexible member to rest on and be supported by the top surface of the sheet member.

26. The apparatus of claim 25 wherein the height level of the top surface of the first electrode means is equal to the height level of the top surface of the second electrode means.

27. A membrane switch comprising:

an insulator having a first surface;

at least one first electrode pair located on said first surface;

at least one second electrode pair located on said first surface laterally spaced from and electrically insulated from said first electrode pair, the electrodes of said second pair being located on generally opposite sides of said first electrode pair;

a flexible nonconductive membrane having a bottom surface;

means supporting said membrane with its bottom surface adjacent to and normally spaced from said first and second electrode pairs, said support means including at least one aperture exposing said first and second electrode pairs to said membrane bottom surface;

first and second conductive means disposed on said bottom surface and positioned opposite said first and second electrode pairs respectively, said first and second conductive portions being electrically insulated from each other and being adapted to electrically bridge said first and second electrode pairs respectively upon deflection of said membrane toward said electrode pairs, whereby said first electrode pair will be bridged prior to bridging of said second electrode pair.

28. The membrane switch defined in claim 27 including:

an array of said first and second electrode pairs on said insulator first surface;

said membrane extending over all pairs of said array;

said support means having apertures formed therein exposing each of said pairs to said membrane bottom surface; and an array of first and second conductive means disposed on said bottom surface corresponding to each of said electrode pairs.

29. The membrane switch as defined in claim 28 wherein said electrode pairs have co-planar top surfaces.

30. The membrane switch defined in claim 28 wherein said support means comprises a nonconductive spacer.

* * * * *

UNITED STATES PATENT AND TRADEMARK OFFICE

CERTIFICATE OF CORRECTION

PATENT NO. : 3,987,259

DATED : October 19, 1976

INVENTOR(S) : Willis August Larson

It is certified that error appears in the above-identified patent and that said Letters Patent are hereby corrected as shown below:

In the title block, the assignee should read --Magic Dot, Inc., Minneapolis, Minnesota, a corporation of Delaware-- instead of "Globe-Union Inc., Milwaukee, Wis."

In Column 3, at line 68, "56-62" should read "56-61"

In Column 5, at line 2, "10-31" should read "20-31"

Signed and Sealed this

Eighteenth Day of January 1977

[SEAL]

*Attest:*

RUTH C. MASON
*Attesting Officer*

C. MARSHALL DANN
*Commissioner of Patents and Trademarks*